US010160927B2

(12) United States Patent
Hellawell et al.

(10) Patent No.: US 10,160,927 B2
(45) Date of Patent: Dec. 25, 2018

(54) LUBRICATING OIL COMPOSITION

(71) Applicant: SHELL OIL COMPANY, Houston, TX (US)

(72) Inventors: Alexander Mark Robert James Hellawell, Cambridge (GB); Robert Wilkinson, Cambridge (GB); Alexander Peter Dirk Massely, Cambridge (GB); Robert Moir, Cambridge (GB); Stuart Browning, Cambridge (GB); Richard Thomas Bown, Cambridge (GB); Sravani Gullapalli, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/536,166

(22) PCT Filed: Dec. 14, 2015

(86) PCT No.: PCT/EP2015/079643
§ 371 (c)(1),
(2) Date: Jun. 15, 2017

(87) PCT Pub. No.: WO2016/096758
PCT Pub. Date: Jun. 23, 2016

(65) Prior Publication Data

US 2017/0362529 A1 Dec. 21, 2017

Related U.S. Application Data

(60) Provisional application No. 62/093,217, filed on Dec. 17, 2014.

(51) Int. Cl.
*C10M 137/16* (2006.01)

(52) U.S. Cl.
CPC .. *C10M 137/16* (2013.01); *C10M 2203/1025* (2013.01); *C10M 2205/173* (2013.01); *C10M 2207/026* (2013.01); *C10M 2207/262* (2013.01); *C10M 2215/064* (2013.01); *C10M 2223/08* (2013.01); *C10N 2210/02* (2013.01); *C10N 2220/025* (2013.01); *C10N 2220/026* (2013.01); *C10N 2220/027* (2013.01); *C10N 2220/028* (2013.01); *C10N 2230/041* (2013.01); *C10N 2230/10* (2013.01); *C10N 2230/12* (2013.01); *C10N 2230/42* (2013.01); *C10N 2230/43* (2013.01); *C10N 2230/45* (2013.01); *C10N 2230/52* (2013.01); *C10N 2230/78* (2013.01); *C10N 2240/102* (2013.01)

(58) Field of Classification Search
CPC ..... C10N 2240/102; C10N 2230/78; C10N 2230/52; C10N 2230/45; C10N 2230/43; C10N 2230/12; C10N 2230/10; C10N 2220/028; C10N 2230/42; C10M 2205/173; C10M 2223/08; C10M 2207/262
USPC ..... 508/422; 556/18; 554/174; 502/162
See application file for complete search history.

(56) References Cited

U.S. PATENT DOCUMENTS

| | | | | |
|---|---|---|---|---|
| 2005/0176978 | A1 | 8/2005 | Verkade et al. | |
| 2011/0245122 | A1 | 10/2011 | Strickland et al. | |
| 2014/0034003 | A1 | 2/2014 | Corradi et al. | |
| 2015/0010748 | A1* | 1/2015 | Chen | C09D 1/00 428/329 |

FOREIGN PATENT DOCUMENTS

| | | | |
|---|---|---|---|
| EP | 0668342 | A1 | 8/1995 |
| EP | 0776959 | A2 | 6/1997 |
| EP | 1029029 | A1 | 8/2000 |
| EP | 1058720 | A1 | 12/2000 |
| WO | 9721788 | A1 | 6/1997 |
| WO | 9826030 | A1 | 6/1998 |
| WO | 9941332 | A1 | 8/1999 |
| WO | 0008115 | A1 | 2/2000 |
| WO | 0014179 | A1 | 3/2000 |
| WO | 0014183 | A1 | 3/2000 |
| WO | 0014187 | A2 | 3/2000 |
| WO | 0014188 | A2 | 3/2000 |

(Continued)

OTHER PUBLICATIONS

International Search Report and Written Opinion received for PCT Patent Application No. PCT/EP2015/079643, dated Mar. 3, 2016, 9 pages.

(Continued)

*Primary Examiner* — Vishal V Vasisth

(57) ABSTRACT

Lubricating composition comprising (i) base oil and (ii) a Verkade base compound having the formula (1): wherein $R^1$, $R^2$ and $R^3$ are each independently selected from hydrogen and saturated or unsaturated, straight chain or branched, $C_1$-$C_{22}$ alkyl groups. The lubricating composition of the present invention exhibits improved base number retention and oxidative stability, particularly in the presence of a biofuel such as fatty acid alkyl ester.

(1)

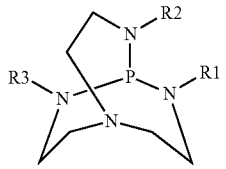

15 Claims, No Drawings

(56) References Cited

FOREIGN PATENT DOCUMENTS

| | | | |
|---|---|---|---|
| WO | 0015736 | A2 | 3/2000 |
| WO | 0118156 | A1 | 3/2001 |
| WO | 0157166 | A1 | 8/2001 |
| WO | 2007045629 | A1 | 4/2007 |

OTHER PUBLICATIONS

Williams et al., "Verkade super base-catalysed transesterification of propylene carbonate with methanol to co-produce dimethyl carbonate and propylene glycol", Journal of Molecular Catalysis A: Chemical, Elsevier, Amsterdam, vol. 304, No. 1-2, May 1, 2009, pp. 147-152, XP026045283.

American Petroleum Institute (API) Publication 1509, 15th Edition, Appendix E, Apr. 2002.

Kirk-Othmer Encyclopedia of Chemical Technology, Third Edition, vol. 14, 1979, pp. 477-526.

* cited by examiner

LUBRICATING OIL COMPOSITION

PRIORITY CLAIM

The present application is the National Stage (§ 371) of International Application No. PCT/EP2015/079643, filed Dec. 14, 2015, which claims priority from U.S. Provisional Application No. 62/093,217, filed Dec. 17, 2014 incorporated herein by reference.

FIELD OF THE INVENTION

The present invention relates to a lubricating oil composition for particular use in the crankcase of a diesel (compression-ignited) internal combustion engine, wherein the internal combustion engine can be fuelled at least in part with a biodiesel fuel, and to the improvement in base number retention and acid number retention as well as an improvement in resistance to oxidation, corrosion and sludge formation of such lubricating oil compositions.

BACKGROUND OF THE INVENTION

Government regulations and market demands continue to emphasize conservation of fossil fuels in the transportation industry. There is therefore an increasing demand for vehicles which are fuelled, either exclusively or partly with fuels from renewable or bio-derived sources (e.g. biodiesel fuels).

It is known to include fatty acid alkyl esters (FAAEs), in particular fatty acid methyl esters (FAMEs), in diesel fuel compositions. FAME is produced via a chemical process called transesterification with methanol in the presence of a catalyst to yield methyl esters. FAME can be produced from various oil-derived feedstocks such as soybean, rapeseed, sunflower seed, coconut and used vegetable oils. FAAEs may be added for a variety of reasons, including to reduce the environmental impact of the fuel production and consumption process or to improve lubricity.

However, it has been found that the lubricant oil compositions used for lubricating an internal combustion engine can often become diluted with the biofuel which is used to fuel the engine. Biodiesel fuels include components of low volatility which are slow to vaporize after injection of the fuel into the engine. Typically, an unburnt portion of the biodiesel and some of the resulting partially combusted decomposition products become mixed with the lubricating oil composition on the cylinder wall and are washed down into the oil sump, thereby contaminating the crankcase lubricant. The biodiesel fuel in the contaminated lubricant may form further decomposition products due to the extreme conditions during lubrication of the engine. In particular, it has been found that dilution of a lubricating oil composition with a FAAE, such as a FAME, can lead to an undesirable effect on a lubricating oil composition's ability to control oxidative stability and to maintain base number. The presence of olefinic double bonds and ester functionality in the biodiesel results in the biodiesel fuels being susceptible to oxidative degradation and renders the lubricating oil composition oxidatively unstable and more susceptible to increase in acid number (TAN), reduction in base number (TBN) and sludge and deposit formation. Oxidation of FAME in the sump leads to the formation of acids. If not neutralised, these acids can cause corrosion. If neutralized by a base containing a metal counterion, they can form sludge. Additionally too much base used in an attempt to neutralise acid formation can lead to ash formation on the DPF. The higher the biodiesel contamination in the oil the lower the oxidative stability of the lubricating oil composition.

Moreover it has been found that this problem of reduced oxidative stability is significantly worse in diesel engines which employ a late post-injection of fuel into the cylinder (e.g. light duty, medium duty and passenger car diesel engines) to regenerate an exhaust gas after-treatment device. This mode of after-treatment device regeneration can lead to higher levels of FAME dilution in the oil.

Accordingly, it would be desirable to provide a lubricating oil composition for use in the crankcase of an internal combustion engine which has improved base number retention and acid number retention, both in the presence or absence of biofuels such as FAME. In addition, it would also be desirable to provide a lubricating oil composition which provides such improved base number retention and acid number retention, without leading to ash formation on the DPF.

It would also be desirable to provide a lubricating oil composition for use in the crankcase of an internal combustion engine which reduces the loss in oxidative stability which can occur when the internal combustion engine is fuelled with a biofuel such as a biodiesel. In addition, it would also be desirable to provide a lubricating oil composition which reduces such loss in oxidative stability without leading to ash formation on the DPF.

Verkade bases are compounds having a football-shaped proazaphosphatrane molecular structure of formula (1) below:

(1)

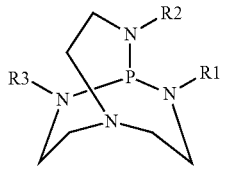

Verkade bases are very strong bases due to the extraordinary stability of the protonated species which is formed when (1) reacts with a proton. Due to the stability of the protonated form, Verkade bases are about eight orders of magnitude stronger as a Lewis base than any amine known.

Verkade bases have been successfully applied in a variety of organic reactions, such as alkylations, dehydrohalogenations, acylations, a variety of condensation and organometallic reactions for carbon-carbon bond formation. A second characteristic of Verkade bases of formula (1) is their ability to act as a superior catalyst for a continuously widening range of reactions such as protecting alcohol groups with various silyl groups during multistep synthesis, trimerizing isocyanates to isocyanurates and the synthesis of alpha, beta-unsaturated nitriles.

It has now surprisingly been found by the present inventors that Verkade bases can be used to improve base number retention and acid number retention of a lubricating oil composition for the crankcase of an internal combustion engine, in particular wherein the internal combustion engine is fuelled with a biofuel composition, in particular a biofuel composition which comprises a fatty acid alkyl ester.

Verkade bases could also be used to reduce the loss in oxidative stability of a lubricating oil composition for the crankcase of an internal combustion engine, wherein the internal combustion engine is fuelled with a biofuel composition, in particular a biofuel composition which comprises a fatty acid alkyl ester.

SUMMARY OF THE INVENTION

According to a first aspect of the present invention there is provided a lubricating composition comprising (i) base oil and (ii) compound having the formula (1):

(1)

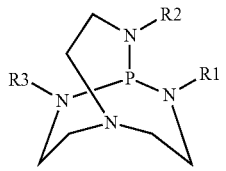

wherein $R^1$, $R^2$ and $R^3$ are each independently selected from hydrogen and saturated or unsaturated, straight chain or branched, $C_1$-$C_{22}$ alkyl groups.

The present invention is especially useful for the case wherein the lubricating oil composition is contaminated with at least 0.3 weight %, based on the total weight of the lubricating oil composition, of a biofuel or a decomposition product thereof, or mixtures thereof.

It has surprisingly been found that the lubricating composition of the present invention exhibits improved base number (TBN) retention and improved acid number (TAN) retention in addition to improved oxidative stability, reduced corrosive properties and reduced tendency to form sludge.

According to a second aspect of the present invention there is provided the use of a compound having the formula (1):

(1)

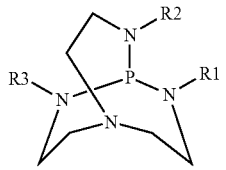

wherein $R^1$, $R^2$ and $R^3$ are each independently selected from hydrogen and saturated or unsaturated, straight chain or branched, $C_1$-$C_{22}$ alkyl groups, in a lubricating composition comprising a base oil for providing improved base number retention of the lubricating composition, particularly in the presence of biofuel, especially wherein the biofuel comprises a fatty acid alkyl ester such as FAME.

According to another aspect of the present invention there is provided a method for improving the base number of lubricating oil compositions, particularly of lubricating oil compositions which are used for lubricating the crankcase of an internal combustion engine which is fuelled with a biofuel composition, preferably wherein the biofuel composition comprises a fatty acid alkyl ester, comprising adding to the lubricating oil composition a compound of formula (1):

(1)

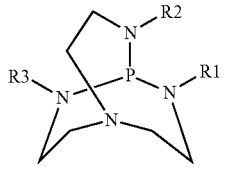

wherein $R^1$, $R^2$ and $R^3$ are each independently selected from hydrogen and saturated or unsaturated, straight chain or branched, $C_1$-$C_{22}$ alkyl groups.

DETAILED DESCRIPTION OF THE INVENTION

As used herein, the term "biofuel" means a fuel derived at least in part from a renewable biological resource, preferably biodiesel fuel.

As mentioned above, it is known that a diesel fuel composition used to fuel a compression ignition engine may incorporate a fatty acid alkyl ester (FAAE) such as a fatty acid methyl ester (FAME) as a fuel component. Unfortunately, however, FAME is much less volatile than conventional diesel so has a much higher tendency to accumulate in the lubricant relative to fossil-derived diesel fuel. Consequently, higher levels of FAME in diesel fuel can lead to higher level of fuel dilution in the lubricant, which can lead in turn to an undesirable loss in oxidation stability of the lubricant.

The present invention is especially useful for the case wherein the lubricating oil composition is contaminated with at least 0.3 weight %, based on the total weight of the lubricating oil composition, of a biofuel or a decomposition product thereof, or mixtures thereof.

As used herein, the term "improving base number retention" means retaining or boosting the total base number (TBN) of a lubrication oil composition which has been diluted with a biofuel, e.g. fatty acid alkyl ester (FAAE) such as a FAME. In a preferred embodiment of the present invention, the TBN of the lubricating oil composition is measured according to ASTM D-2896 and ASTM D-4739 which are standard test methods for measuring the TBN of a lubricating oil composition.

As used herein, the term "improving acid number retention" means retaining or decreasing the total acid number (TAN) of a lubrication oil composition which has been diluted with a biofuel, e.g. fatty acid alkyl ester (FAAE) such as a FAME. In a preferred embodiment of the present invention, the TAN of the lubricating oil composition is measured according to ASTM D-664 which is a standard test method for measuring the TAN of a lubricating oil composition.

As used herein, the term "reducing the loss in oxidative stability" means reducing the loss in oxidative stability which is experienced when a lubricating oil composition is diluted with a biofuel, e.g. fatty acid alkyl ester (FAAE) such as a FAME.

As used herein, the term "improving oxidative stability" means increasing the onset time to oxidation of a lubricating oil composition which has been diluted with a biofuel, e.g. fatty acid alkyl ester (FAAE) such as a FAME, as measured by ASTM D6186 which is a standard test method for measuring oxidation induction time of a lubricating oil composition by Pressure Differential Scanning Calorimetry (pDSC).

In a preferred embodiment, the % improvement in base number retention provided by the lubricating oil compositions of the present invention is at least a 5% improvement in base number retention, more preferably at least a 10% improvement in base number retention, even more preferably at least a 15% improvement, especially at least a 20% improvement in base number retention, compared to the base number retention of an equivalent lubricating oil composition which has been diluted with FAME but which does not contain a Verkade base of formula (1).

In a preferred embodiment, the % reduction in acid number provided by the lubricating oil compositions of the present invention is at least a 5% reduction in acid number, more preferably at least a 10% reduction in acid number, even more preferably at least a 20% reduction, especially at least a 60% reduction in acid number, compared to the acid number of an equivalent lubricating oil composition which has been diluted with FAME but which does not contain a Verkade base of formula (1).

In a preferred embodiment, the % improvement in oxidative stability provided by the lubricating oil compositions of the present invention is at least a 20% improvement in oxidative stability, more preferably at least a 30% improvement in oxidative stability, even more preferably at least a 50% improvement, especially at least a 60% improvement in oxidative stability, compared to the oxidative stability of an equivalent lubricating oil composition which has been diluted with FAME but which does not contain a compound of formula (1).

As used herein, the term "reduced corrosive properties" means (i) improving base number retention in a lubricating oil composition that is diluted with a biofuel, and/or (ii) improving acid number retention of a FAME-diluted lubricating composition beyond that of an equivalent FAME-diluted lubricating composition which does not contain a compound of formula (1).

As used herein, the term "improving the resistance to oxidation" means (i) reducing the loss in oxidative stability which is experienced when a lubricating oil composition is diluted with a biofuel, and/or (ii) improving the oxidative stability of a FAME-diluted lubricating composition beyond that of an equivalent FAME-diluted lubricating composition which does not contain a compound of formula (1).

In a preferred embodiment of the present invention, the oxidative stability of the lubricating oil composition is measured according to ASTM D6186 which is a standard test method for measuring oxidation induction time of a lubricating oil composition by Pressure Differential Scanning Calorimetry (pDSC).

The FAAE will typically be added to the fuel composition as a blend (i.e. a physical mixture), conveniently before the composition is introduced into an internal combustion engine or other system which is to be run on the composition. Other fuel components and/or fuel additives may also be incorporated into the composition, either before or after addition of the FAAE and either before or during use of the composition in a combustion system.

The amount of FAAE added will depend on the nature of the base fuel and FAAE in question and on the target cetane number. In general, the volume fraction v of FAAE in the resultant base fuel/FAAE mixture will be less than the volume fraction v' which would be required if linear blending rules applied, wherein v' would be defined by the equation:

$$X=A+v'(B-A).$$

The volume fractions v and v' must each have a value between 0 and 1. When carrying out the method of the present invention the actual volume fraction of FAAE, v, is preferably at least 0.02 lower than the "linear" volume fraction v', more preferably at least 0.05 or 0.08 or 0.1 lower, most preferably at least 0.2, 0.3 or 0.5 lower and in cases up to 0.6 or 0.8 lower than v'. In absolute terms, the actual volume fraction v is preferably 0.25 or less, more preferably 0.2 or less, yet more preferably 0.15 or 0.1 or 0.07 or less. It may for example be from 0.01 to 0.25, preferably from 0.05 to 0.25, more preferably from 0.05 or 0.1 to 0.2.

The concentration of the FAAE in the overall fuel composition (or at least in the base fuel/FAAE mixture) is preferably 25% v/v or less, more preferably 20% v/v or less, yet more preferably 15 or 10 or 7% v/v or less. As a minimum it may be 0.05% v/v or greater, preferably 1% v/v or greater, more preferably 2% or 5% v/v or greater, most preferably 7 or 10% v/v or greater. As used herein, B7 FAME refers to 7% v/v concentration of the FAME in the overall fuel composition. As used herein, B100 FAME refers to 100% v/v concentration of the FAME in the overall fuel composition or 100% neat FAME. As used herein, $B_0$ means FAME-free diesel fuel.

Fatty acid alkyl esters, of which the most commonly used in the present context are the methyl esters, are already known as renewable diesel fuels (so-called "biodiesel" fuels). They contain long chain carboxylic acid molecules (generally from 10 to 22 carbon atoms long), each having an alcohol molecule attached to one end. Organically derived oils such as vegetable oils (including recycled vegetable oils) and animal fats can be subjected to a transesterification process with an alcohol (typically a $C_1$ to $C_5$ alcohol) to form the corresponding fatty esters, typically mono-alkylated. This process, which is suitably either acid- or base-catalysed, such as with the base KOH, converts the triglycerides contained in the oils into fatty acid esters and free glycerol, by separating the fatty acid components of the oils from their glycerol backbone.

In the present invention, the FAAE may be any alkylated fatty acid or mixture of fatty acids. Its fatty acid component (s) are preferably derived from a biological source, more preferably a vegetable source. They may be saturated or unsaturated; if the latter, they may have one or more double bonds. They may be branched or un-branched. Suitably they will have from 10 to 30, more suitably from 10 to 22 or from 12 to 22, carbon atoms in addition to the acid group(s) —$CO_2H$. A FAAE will typically comprise a mixture of different fatty acid esters of different chain lengths, depending on its source. For instance the commonly available rapeseed oil contains mixtures of palmitic acid ($C_{16}$), stearic acid ($C_{18}$), oleic, linoleic and linolenic acids ($C_{18}$, with one, two and three unsaturated carbon-carbon bonds respectively) and sometimes also erucic acid ($C_{22}$)—of these the oleic and linoleic acids form the major proportion. Soybean oil contains a mixture of palmitic, stearic, oleic, linoleic and linolenic acids. Palm oil usually contains a mixture of palmitic, stearic and linoleic acid components.

The FAAE used in the present invention is preferably derived from a natural fatty oil, for instance a vegetable oil such as rapeseed oil, soybean oil, coconut oil, sunflower oil, palm oil, peanut oil, linseed oil, camelina oil, safflower oil, babassu oil, tallow oil or rice bran oil. It may in particular be an alkyl ester (suitably the methyl ester) of rapeseed, soy, coconut or palm oil.

The FAAE is preferably a $C_1$ to $C_5$ alkyl ester, more preferably a methyl, ethyl or propyl (suitably iso-propyl) ester, yet more preferably a methyl or ethyl ester and in particular a methyl ester.

It may for example be selected from the group consisting of rapeseed methyl ester (RME, also known as rape oil methyl ester or rape methyl ester), soy methyl ester (SME, also known as soybean methyl ester), palm oil methyl ester (POME), coconut methyl ester (CME) (in particular unrefined CME; the refined product is based on the crude but with some of the higher and lower alkyl chains (typically the $C_6$, $C_8$, $C_{10}$, $C_{16}$ and $C_{18}$) components removed) and mixtures thereof. In general it may be either natural or synthetic, refined or unrefined ("crude").

The FAAE suitably complies with specifications applying to the rest of the fuel composition, and/or to the base fuel to which it is added, bearing in mind the intended use to which the composition is to be put (for example, in which geographical area and at what time of year). In particular, the FAAE preferably has a flash point (IP 34) of greater than 101° C.; a kinematic viscosity at 40° C. (IP 71) of 1.9 to 6.0 centistokes, preferably 3.5 to 5.0 centistokes; a density from 845 to 910 kg/m$^3$, preferably from 860 to 900 kg/m$^3$, at 15° C. (IP 365, EN ISO 12185 or EN ISO 3675); a water content (IP 386) of less than 500 ppm; a T95 (the temperature at which 95% of the fuel has evaporated, measured according to IP 123) of less than 360° C.; an acid number (IP 139) of less than 0.8 mgKOH/g, preferably less than 0.5 mgKOH/g; and an iodine number (IP 84) of less than 125, preferably less than 120 or less than 115, grams of iodine ($I_2$) per 100 g of fuel. It also preferably contains (e.g., by NMR) less than 0.2% w/w of free methanol, less than 0.02% w/w of free glycerol and greater than 96.5% w/w esters. In general it may be preferred for the FAAE to conform to the European specification EN 14214 for fatty acid methyl esters for use as diesel fuels.

The measured cetane number of the FAAE (ASTM D613) is suitably 55 or greater, preferably 58 or 60 or 65 or even 70 or greater.

Two or more FAAEs may be added to the base fuel, either separately or as a pre-prepared blend, so long as their combined effect is to increase the cetane number of the resultant composition to reach the target number X. In this case the total amount x' of the two or more FAAEs must be less than the amount of that same combination of FAAEs which would need to be added to the base fuel in order to achieve the target cetane number X if linear blending rules applied for both or all of the FAAEs.

The FAAE preferably comprises (i.e. either is or includes) RME or SME.

The FAAE may be added to the fuel composition for one or more other purposes in addition to the desire to increase cetane number, for instance to reduce life cycle greenhouse gas emissions, to improve lubricity and/or to reduce costs.

The lubricating oil composition herein typically comprises a base oil and one or more performance additives, in addition to one or more Verkade base compounds.

There are no particular limitations regarding the base oil used in the lubricating oil compositions herein, and various conventional mineral oils, synthetic oils as well as naturally derived esters such as vegetable oils may be conveniently used.

The base oil used in the present invention may conveniently comprise mixtures of one or more mineral oils and/or one or more synthetic oils; thus, the term "base oil" herein may refer to a blend containing more than one base oil.

Suitable base oils for use in the lubricating oil composition of the present invention are Group I-III mineral base oils (preferably Group III), Group IV poly-alpha olefins (PAOs), Group II-III Fischer-Tropsch derived base oils (preferably Group III), Group V base oils, and mixtures thereof.

By "Group I", "Group II" "Group III" and "Group IV" and "Group V" base oils in the present invention are meant lubricating oil base oils according to the definitions of American Petroleum Institute (API) for categories I, II, III, IV and V. These API categories are defined in API Publication 1509, 15th Edition, Appendix E, April 2002.

Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

A preferred base oil for use in the lubricating oil compositions herein is a Fischer-Tropsch derived base oil. Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the lubricating oil composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Typically, the aromatics content of a Fischer-Tropsch derived base oil, suitably determined by ASTM D 4629, will typically be below 1 wt. %, preferably below 0.5 wt. % and more preferably below 0.1 wt. %. Suitably, the base oil has a total paraffin content of at least 80 wt. %, preferably at least 85, more preferably at least 90, yet more preferably at least 95 and most preferably at least 99 wt. %. It suitably has a saturates content (as measured by IP-368) of greater than 98 wt. %. Preferably the saturates content of the base oil is greater than 99 wt. %, more preferably greater than 99.5 wt. %. It further preferably has a maximum n-paraffin content of 0.5 wt. %. The base oil preferably also has a content of naphthenic compounds of from 0 to less than 20 wt. %, more preferably of from 0.5 to 10 wt. %.

Typically, when present in the lubricating oil compositions herein, the Fischer-Tropsch derived base oil or base oil blend has a kinematic viscosity at 100° C. (as measured by ASTM D 7042) in the range of from 1 to 30 mm$^2$/s (cSt), preferably from 1 to 25 mm$^2$/s (cSt), and more preferably from 2 mm$^2$/s to 12 mm$^2$/s. Preferably, the Fischer-Tropsch derived base oil has a kinematic viscosity at 100° C. (as measured by ASTM D 7042) of at least 2.5 mm$^2$/s, more preferably at least 3.0 mm$^2$/s. In one embodiment of the present invention, the Fischer-Tropsch derived base oil has a kinematic viscosity at 100° C. of at most 5.0 mm$^2$/s, preferably at most 4.5 mm$^2$/s, more preferably at most 4.2 mm$^2$/s (e.g. "GTL 4"). In another embodiment of the present invention, the Fischer-Tropsch derived base oil has a kinematic viscosity at 100° C. of at most 8.5 mm$^2$/s, preferably at most 8 mm$^2$/s (e.g. "GTL 8").

Further, the Fischer-Tropsch derived base oil when present in the lubricating oil composition herein typically has a kinematic viscosity at 40° C. (as measured by ASTM D 7042) of from 10 to 100 mm$^2$/s (cSt), preferably from 15 to 50 mm$^2$/s.

Also, a preferred Fischer-Tropsch derived base oil for use herein has a pour point (as measured according to ASTM D 5950) of below −30° C., more preferably below −40° C., and most preferably below −45° C.

The flash point (as measured by ASTM D92) of the Fischer-Tropsch derived base oil is preferably greater than 120° C., more preferably even greater than 140° C.

A preferred Fischer-Tropsch derived base oil for use herein has a viscosity index (according to ASTM D 2270) in the range of from 100 to 200. Preferably, the Fischer-Tropsch derived base oil has a viscosity index of at least 125, preferably 130. Also it is preferred that the viscosity index is below 180, preferably below 150.

In the event the Fischer-Tropsch derived base oil contains a blend of two or more Fischer-Tropsch derived base oils, the above values apply to the blend of the two or more Fischer-Tropsch derived base oils.

The lubricating oil composition herein preferably comprises 80 wt % or greater of Fischer-Tropsch derived base oil.

Synthetic oils include hydrocarbon oils such as olefin oligomers (including polyalphaolefin base oils; PAOs), dibasic acid esters, polyol esters, polyalkylene glycols (PAGs), alkyl naphthalenes and dewaxed waxy isomerates. Synthetic hydrocarbon base oils sold by the Shell Group under the designation "Shell XHVI" (trade mark) may be conveniently used.

Poly-alpha olefin base oils (PAOs) and their manufacture are well known in the art. Preferred poly-alpha olefin base oils that may be used in the lubricating oil compositions of the present invention may be derived from linear $C_2$ to $C_{32}$, preferably $C_6$ to $C_{16}$, alpha olefins. Particularly preferred feedstocks for said poly-alpha olefins are 1-octene, 1-decene, 1-dodecene and 1-tetradecene.

There is a strong preference for using a Fischer-Tropsch derived base oil over a PAO base oil, in view of the high cost of manufacture of the PAOs. Thus, preferably, the base oil contains more than 50 wt. %, preferably more than 60 wt. %, more preferably more than 70 wt. %, even more preferably more than 80 wt. %. most preferably more than 90 wt. % Fischer-Tropsch derived base oil. In an especially preferred embodiment not more than 5 wt. %, preferably not more than 2 wt. %, of the base oil is not a Fischer-Tropsch derived base oil. It is even more preferred that 100 wt % of the base oil is based on one or more Fischer-Tropsch derived base oils.

The total amount of base oil incorporated in the lubricating oil composition of the present invention is preferably in the range of from 60 to 99 wt. %, more preferably in the range of from 65 to 90 wt. % and most preferably in the range of from 70 to 85 wt. %, with respect to the total weight of the lubricating oil composition.

Typically the base oil (or base oil blend) as used according to the present invention has a kinematic viscosity at 100° C. (according to ASTM D445) of above 2.5 cSt and up to 8 cSt. According to a preferred embodiment of the present invention the base oil has a kinematic viscosity at 100° C. (according to ASTM D445) of between 3.5 and 8 cSt. In the event the base oil contains a blend of two or more base oils, it is preferred that the blend has a kinematic viscosity at 100° C. of between 3.5 and 7.5 cSt.

The lubricating composition herein preferably has a Noack volatility (according to ASTM D 5800) of below 15 wt. %. Typically, the Noack volatility (according to ASTM D 5800) of the composition is between 1 and 15 wt. %, preferably below 14.6 wt. % and more preferably below 14.0 wt. %.

The lubricating oil composition of the present invention comprises one or more Verkade bases having the formula (1) below:

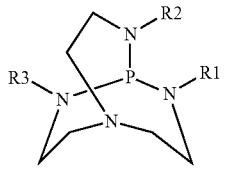

(1)

wherein $R^1$, $R^2$ and $R^3$ are each independently selected from hydrogen and saturated or unsaturated, straight chain or branched, $C_1$-$C_{22}$ alkyl groups.

In a preferred embodiment of the present invention, $R^1$, $R^2$ and $R^3$ are each independently selected from hydrogen and saturated or unsaturated, straight chain or branched, $C_1$-$C_{12}$ alkyl groups. Examples of suitable $R^1$, $R^2$ and $R^3$ groups are hydrogen, $CH_3$, $CH_2CH_3$, i-$C_3H_7$, $CH_2C(CH_3)_3$, i-$C_4H_9$ and $CH_2$-p-$C_6H_4OCH_3$.

In another preferred embodiment of the present invention, $R^1$, $R^2$ and $R^3$ are each independently selected from saturated or unsaturated, straight chain or branched, $C_3$-$C_{12}$ alkyl groups. Preferably, $R^1$, $R^2$ and $R^3$ are each independently selected from saturated, branched chain $C_3$-$C_{12}$ alkyl groups. More preferably, $R^1$, $R^2$ and $R^3$ are each independently selected from saturated, branched chain $C_3$-$C_6$ alkyl groups. In a particularly preferred embodiment, $R^1$, $R^2$ and $R^3$ are saturated, branched chain $C_3$ or $C_4$ alkyl groups.

In one embodiment of the present invention, $R^1$, $R^2$ and $R^3$ are the same.

Examples of suitable Verkade bases for use herein include 2,8,9-Triisobutyl-2,5,8,9-tetraaza-1-phosphabicyclo[3.3.3]undecane, 2,8,9-Triisopropyl-2,5,8,9-tetraaza-1-phosphabicyclo[3,3,3]undecane and 2,8,9-Trimethyl-2,5,8,9-tetraaza-1-phosphabicyclo[3,3,3]undecane, and mixtures thereof. All of these compounds are commercially available from Sigma-Aldrich. Other examples of Verkade bases are 2,5,8,9-Tetraaza-1-phosphabicyclo[3.3.3]undecane, 2,8-bis(2-methylpropyl), 2,5,8,9-Tetraaza-1-phosphabicyclo[3.3.3]undecane, 2-(2,2-dimethylpropyl)-8-(2-methylpropyl)-9-(phenylmethyl)-2,5,8,9-Tetraaza-1-phosphabicyclo[3.3.3]undecane.

A particularly preferred Verkade base for use herein is 2,8,9-Triisobutyl-2,5,8,9-tetraaza-1-phosphabicyclo[3.3.3]undecane.

The Verkade base of formula (1) is preferably present in an amount in the range of from 0.01 wt % to 5 wt %, more preferably in an amount of from 0.1 wt % to 3 wt %, and even more preferably in an amount of from 0.1 wt % to 1 wt %, by weight of the total lubricating oil composition.

The lubricating oil composition herein further comprises one or more performance additives, in addition to the Verkade base of formula (1), such as anti-oxidants, anti-wear additives, dispersants, detergents, overbased detergents, extreme pressure additives, friction modifiers, viscosity index improvers, pour point depressants, metal passivators, corrosion inhibitors, demulsifiers, anti-foam agents, seal compatibility agents and additive diluent base oils, etc.

As the person skilled in the art is familiar with the above and other additives, these are not further discussed here in detail. Specific examples of such additives are described in for example Kirk-Othmer Encyclopedia of Chemical Technology, third edition, volume 14, pages 477-526.

Conventional anti-oxidants that may be conveniently used in the lubricating oil compositions of the present invention, include diphenylamines (such as "IRGANOX L-57" available from Ciba Specialty Chemicals) as e.g. disclosed in WO 2007/045629 and EP 1 058 720 B1, phenolic anti-oxidants, etc. The teaching of WO 2007/045629 and EP 1 058 720 B1 is hereby incorporated by reference.

Anti-wear additives that may be conveniently used include zinc-containing compounds such as zinc dithiophosphate compounds selected from zinc dialkyl-, diaryl- and/or alkylaryl-dithiophosphates, molybdenum-containing compounds, boron-containing compounds and ashless anti-wear additives such as substituted or unsubstituted thiophosphoric acids, and salts thereof.

Examples of such molybdenum-containing compounds may conveniently include molybdenum dithiocarbamates, trinuclear molybdenum compounds, for example as described in WO 98/26030, sulphides of molybdenum and molybdenum dithiophosphate.

Boron-containing compounds that may be conveniently used include borate esters, borated fatty amines, borated epoxides, alkali metal (or mixed alkali metal or alkaline earth metal) borates and borated overbased metal salts.

The dispersant used is preferably an ashless dispersant. Suitable examples of ashless dispersants are polybutylene succinimide polyamines and Mannich base type dispersants.

The detergent used is preferably an overbased detergent or detergent mixture containing e.g. salicylate, sulphonate and/or phenate-type detergents.

Examples of viscosity index improvers, which may conveniently be used in the lubricating oil composition of the present invention include the styrene-butadiene stellate copolymers, styrene-isoprene stellate copolymers and the polymethacrylate copolymer and ethylene-propylene copolymers (also known as olefin copolymers) of the crystalline and non-crystalline type. Dispersant-viscosity index improvers may be used in the lubricating oil composition of the present invention. However, preferably the composition according to the present invention contains less than 1.0 wt. %, preferably less than 0.5 wt. %, of a Viscosity Index improver concentrate (i.e. VI improver plus "carrier oil" or "diluent"), based on the total weight of the composition. Most preferably, the composition is free of Viscosity Index improver concentrate. The term "Viscosity Modifier" as used hereafter (such as in Table 2) is meant to be the same as the above-mentioned term "Viscosity Index improver concentrate".

Preferably, the composition contains at least 0.1 wt. % of a pour point depressant. As an example, alkylated naphthalene and phenolic polymers, polymethacrylates, maleate/fumarate copolymer esters may be conveniently used as effective pour point depressants. Preferably not more than 0.3 wt. % of the pour point depressant is used.

Furthermore, compounds such as alkenyl succinic acid or ester moieties thereof, benzotriazole-based compounds and thiodiazole-based compounds may be conveniently used in the lubricating oil composition herein as corrosion inhibitors.

Compounds such as polysiloxanes, dimethyl polycyclohexane and polyacrylates may be conveniently used in the lubricating oil composition herein as defoaming agents.

Compounds which may be conveniently used in the lubricating oil composition herein as seal fix or seal compatibility agents include, for example, commercially available aromatic esters.

The lubricating oil compositions herein may be conveniently prepared by admixing the Verkade base (s) of formula (1) with the base oil(s), and one or more additional performance additives.

The above-mentioned performance additives are typically present in an amount in the range of from 0.01 to 35.0 wt. %, based on the total weight of the lubricating oil composition, preferably in an amount in the range of from 0.05 to 25.0 wt. %, more preferably from 1.0 to 20.0 wt. %, based on the total weight of the lubricating oil composition.

Preferably, the composition contains at least 8.0 wt. %, preferably at least 10.0 wt. %, more preferably at least 11.0 wt % of an additive package comprising an anti-wear additive, a metal detergent, an ashless dispersant, an anti-oxidant, a friction modifier and an anti-foaming agent.

The lubricating oil compositions herein may be so-called "low SAPS" (SAPS=sulphated ash, phosphorus and sulphur), "mid SAPS" or "regular SAPS" formulations.

For Passenger Car Motor Oil (PCMO) engine oils the above ranges mean:

- a sulphated ash content (according to ASTM D 874) of up to 0.5 wt. %, up to 0.8 wt. % and up to 1.5 wt. %, respectively;
- a phosphorus content (according to ASTM D 5185) of up to 0.05 wt. %, up to 0.08 wt. % and typically up to 0.1 wt. %, respectively; and
- a sulphur content (according to ASTM D 5185) of up to 0.2 wt. %, up to 0.3 wt. % and typically up to 0.5 wt. %, respectively.

For Heavy Duty Diesel Engine Oils the above ranges mean:

- a sulphated ash content (according to ASTM D 874) of up to 1 wt. %, up to 1 wt. % and up to 2 wt. %, respectively;
- a phosphorus content (according to ASTM D 5185) of up to 0.08 wt. % (low SAPS) and up to 0.12 wt. % (mid SAPS), respectively; and
- a sulphur content (according to ASTM D 5185) of up to 0.3 wt. % (low SAPS) and up to 0.4 wt. % (mid SAPS), respectively.

The present invention is described below with reference to the following Examples, which are not intended to limit the scope of the present invention in any way.

Example

Comparative Example 1 (Oil A) was a commercially available 5W-30 heavy duty diesel engine oil having a HTHS (High Temperature High Shear) at 150° C. (as measured by ASTM D5481) of 3.5 and containing 16 wt % of additives (which includes salicylate detergent, dispersant, zinc-based anti-wear agent, a mixture of aminic and phenolic antioxidants and a corrosion inhibitor), up to 10 wt % of a polymeric viscosity modifier and the remainder a blend of Group III base oils.

Comparative Example 2 (Oil B) was a blend of 95 wt % Oil A+5 wt % B7 FAME.

Comparative Example 3 (Oil C) was a blend of 90 wt % Oil A+10 wt % B100 FAME.

Example 1 was a blend of 99.5 wt % Comparative Example 1 (Oil A) with 0.5 wt % of a Verkade base (2,8,9-Triisobutyl-2,5,8,9-tetraaza-1-phosphabicyclo[3.3.3]undecane, commercially available from Sigma-Aldrich). Example 1 was obtained by mixing Comparative Example 1 with said Verkade base using conventional lubricating blending procedures.

Example 2 was a blend of 99.5 wt % Comparative Example 2 (Oil B) with 0.5 wt % of a Verkade base (2,8,9-Triisobutyl-2,5,8,9-tetraaza-1-phosphabicyclo[3.3.3] undecane, commercially available from Sigma-Aldrich). Example 2 was obtained by mixing Comparative Example 2 with said Verkade base using conventional lubricating blending procedures.

Example 3 was a blend of 99.5 wt % Comparative Example 3 (Oil C) with 0.5 wt % of a Verkade base (2,8,9-Triisobutyl-2,5,8,9-tetraaza-1-phosphabicyclo[3.3.3] undecane, commercially available from Sigma-Aldrich). Example 3 was obtained by mixing Comparative Example 3 with said Verkade base using conventional lubricating blending procedures.

In order to measure the oxidative stability of the Examples and Comparative Examples, each of the lubricating oil compositions were subjected to the following oxidation test.

Oxidation Test

In this test, the oxidation of crankcase lubricants is simulated by bubbling air into a heated oil sample without a metal catalyst. 300 g oil samples are weighed into glass oxidation cells. The heat is turned on and the heating block unit is allowed to come to the desired temperature (155° C.). The cells are placed in the heating unit and the air bubblers are connected. The gas flow is turned on and the air is adjusted to desired level (200 cc/min per tube). Constant heat and gas flow is maintained for the duration of the test (3-7 days). Periodically (typically every 24 hours) samples of withdrawn for required tests. Each of the samples are subjected to ASTM D-664 which is a standard test method for measuring the Total Acid Number (TAN). In addition, each of the samples are subjected to ASTM D-2896 and ASTM D-4739 which measures the Total Base Number (TBN). The results of these test measurements are set out in Table 1.

5% B7 FAME (Oil B), a reduction in TBN (both by ASTM D-2896 and ASTM D-4739) is seen over the duration of the test (Start of Test to Day 4). A further reduction in TBN (both by ASTM D-2896 and ASTM D-4739) on diluting the lubricating composition of Comparative Example 1 with 10% B100 FAME (Oil C) over the duration of the test. Also, the TAN of Oil B and Oil C is much higher than Oil A at the end of test on Day 4. The reduction in the TBN and increase in TAN at the end of test in both Oil B and Oil C is indicative of increased acid formation.

The results in Table 1 also demonstrate that the addition of Verkade base at a treat rate of 0.5 wt % in a lubricating composition (Example 1, 2 and 3) provides a boost in the TBN (both by ASTM D-2896 and ASTM D-4739) at the start of the test.

Example 1 demonstrates that the use of the Verkade base at a treat rate of 0.5 wt % boosts the TBN retention by 9-14% of the lubricating composition in Comparative Example 1 over the duration of the test (Start of Test to Day 4). Additionally, a significant decrease in the TAN (>10%) from start of the test to Day 4 is seen in Example 1 with the addition of 0.5 wt % of the Verkade base, indicating decreased acid formation and thus reduced corrosivity.

Example 2 demonstrates that even in the presence of 5 wt % B7 FAME, the use of the Verkade base at a treat rate of 0.5 wt % boosts the TBN retention by >7% (Start of Test to Day 3) of the lubrication composition in Comparative Example 2. Again, a decrease in TAN (>18%) from start of the test to Day 3 is seen in Example 2 with the addition of 0.5 wt % of the Verkade base. On Day 4, TBN and TAN are retained and similar to Comparative Example 2.

Example 3 demonstrates that in the presence of 10 wt % B100 FAME, the use of Verkade base at a treat rate of 0.5 wt % boosts the TBN retention by >9% and the TAN is decreased by >60% at the start of the test. Through the duration of the test, while the TBN of Example 3 is similar

TABLE 1

| | Comparative Example 1 Finished Lubricant (Oil A) | | | Comparative Example 2 95 wt % Oil A + 5 wt % B7 FAME (Oil B) | | | Comparative Example 3 90 wt % Oil A + 10 wt % B100 FAME (Oil C) | | |
|---|---|---|---|---|---|---|---|---|---|
| Blend | TAN ASTM D-664 | TBN1 ASTM D-2896 | TBN2 ASTM D-4739 | TAN ASTM D-664 | TBN1 ASTM D-2896 | TBN2 ASTM D-4739 | TAN ASTM D-664 | TBN1 ASTM D-2896 | TBN2 ASTM D-4739 |
| Start of Test | 1.74 | 10.33 | 8.83 | 1.6 | 9.85 | 8.53 | 1.66 | 9.34 | 8.22 |
| Day 1 | 1.28 | 9.21 | 7.23 | 1.2 | 8.86 | 7.11 | 0.99 | 8.65 | 6.17 |
| Day 2 | 0.96 | 8.35 | 5.86 | 0.87 | 8.19 | 5.68 | 1.44 | 7.25 | 4.59 |
| Day 3 | 0.73 | 7.91 | 5.14 | 0.91 | 7.7 | 4.41 | 1.37 | 6.44 | 3.43 |
| Day 4 | 0.74 | 7.72 | 4.75 | 0.87 | 7.36 | 4.36 | 1.65 | 5.8 | 3.03 |

| | Example 1 99.5 wt % Oil A + 0.5 wt % Verkade Base | | | Example 2 99.5 wt % Oil B + 0.5 wt % Verkade Base | | | Example 3 99.5 wt % Oil C + 0.5 wt % Verkade Base | | |
|---|---|---|---|---|---|---|---|---|---|
| Blend | TAN ASTM D-664 | TBN1 ASTM D-2896 | TBN2 ASTM D-4739 | TAN ASTM D-664 | TBN1 ASTM D-2896 | TBN2 ASTM D-4739 | TAN ASTM D-664 | TBN1 ASTM D-2896 | TBN2 ASTM D-4739 |
| Start of Test | 1.06 | 11.24 | 9.93 | 1.02 | 10.81 | 9.64 | 0.66 | 10.2 | 9.09 |
| Day 1 | 0.62 | 10.09 | 7.31 | 0.58 | 9.66 | 7.11 | 1.04 | 8.68 | 5.88 |
| Day 2 | 0.46 | 9.41 | 6.03 | 0.56 | 9.33 | 6.11 | 1.06 | 7.25 | 3.79 |
| Day 3 | 0.66 | 9.05 | 5.74 | 0.74 | 8.73 | 5.38 | 1.26 | 6.36 | 3.24 |
| Day 4 | 0.64 | 8.69 | 5.26 | 0.88 | 8.27 | 4.17 | 1.4 | 5.6 | 2.72 |

Discussion

It can be seen from the results in Table 1 that by diluting the lubricating composition of Comparative Example 1 with to Comparative Example 3, the TAN of Example 3 is still reduced by >8%. This indicates the TBN retention capability of lubricating oil composition in Example 3, while maintaining a low TAN and thus low acid formation that leads to increased corrosivity. While not wishing to be limited by theory, the lack of a visible boost in the TBN retention could be attributed to solubility constraints of using the Verkade base at a higher treat rate, however the person skilled in the art would realise that this could be fixed by, for example, adjusting the temperature that is used to make the lubricating composition.

That which is claimed is:

1. A lubricating composition comprising (I) base oil and (ii) compound having the formula (1):

(1)

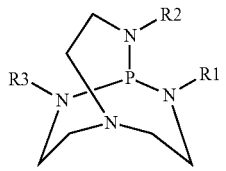

wherein R1, R2 and R3 are each independently selected from hydrogen and saturated or unsaturated, straight chain or branched, C1-C22 alkyl groups.

2. The lubricating composition according to claim 1 wherein R1, R2 and R3 are each independently selected from saturated or unsaturated, straight chain or branched, C3-C12 alkyl groups.

3. The lubricating composition according to claim 1 wherein R1, R2 and R3 are each independently selected from saturated or unsaturated, branched chain C3-C12 alkyl groups.

4. The lubricating composition according to claim 1 wherein R1, R2 and R3 are each independently selected from saturated, branched chain C3-C12 alkyl groups.

5. The lubricating composition according to claim 1 wherein R1, R2 and R3 are each independently selected from saturated, branched chain C3-C6 alkyl groups.

6. The lubricating composition according to claim 1 wherein R1, R2 and R3 are the same.

7. The lubricating composition according to claim 6 wherein R1, R2 and R3 are saturated, branched chain C3 or C4 alkyl groups.

8. The lubricating composition according to claim 1 wherein the compound of formula (1) is present at a level of from 0.01 wt % to 5 wt %.

9. The lubricating oil composition according to claim 1 wherein the lubricating oil composition is contaminated with at least 0.3 wt %, based on the total weight of the lubricating oil composition, of a biofuel or a decomposition product thereof, or a mixture thereof.

10. The lubricating composition according to claim 1 wherein the base oil comprises a Fischer-Tropsch derived base oil.

11. The lubricating composition according to claim 1 additionally comprising a performance additive.

12. The lubricating composition according to claim 1 wherein the lubricating composition is a heavy-duty diesel engine oil.

13. A method for improving the base number retention of a lubricating oil composition used for lubricating a crankcase of an internal combustion engine fueled with a biofuel composition, wherein the biofuel composition is a biodiesel composition comprising a fatty acid alkyl ester, wherein the method comprises adding to the lubricating oil composition a compound of formula (1):

(1)

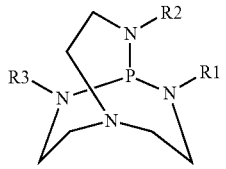

wherein R1, R2 and R3 are each independently selected from hydrogen and saturated or unsaturated, straight chain or branched, C1-C22 alkyl groups.

14. The lubricating composition according to claim 1 wherein the compound of formula (1) is present at a level of from 0.1 wt % to 3 wt %, by weight of the lubricating composition.

15. The lubricating composition according to claim 1 wherein the compound of formula (1) is present at a level of from 0.1 to 1 wt %, by weight of the lubricating composition.

* * * * *